US008042215B2

(12) United States Patent
Thibault

(10) Patent No.: US 8,042,215 B2
(45) Date of Patent: Oct. 25, 2011

(54) CLEANING SYSTEM FOR REMOVING ABRADING MATERIAL

(76) Inventor: Richard R. Thibault, Shelby Township, MI (US)

( * ) Notice: Subject to any disclaimer, the term of this patent is extended or adjusted under 35 U.S.C. 154(b) by 248 days.

(21) Appl. No.: 12/479,045

(22) Filed: Jun. 5, 2009

(65) Prior Publication Data

US 2009/0300869 A1 Dec. 10, 2009

Related U.S. Application Data

(60) Provisional application No. 61/059,930, filed on Jun. 9, 2008.

(51) Int. Cl.
*A46B 17/06* (2006.01)
*A47L 13/50* (2006.01)

(52) U.S. Cl. ..... 15/142; 15/257.01; 15/264; 15/DIG. 9; 68/223

(58) Field of Classification Search ..... 15/104.92, 15/142, 257.01, 257.05, 257.06, 260, 264, 15/DIG. 9; 68/223, 226, 228, 229, 230.3
See application file for complete search history.

(56) References Cited

U.S. PATENT DOCUMENTS

| | | | | | |
|---|---|---|---|---|---|
| 1,788,844 | A | * | 1/1931 | Powell | 15/142 |
| 1,795,416 | A | * | 3/1931 | Weil | 15/142 |
| 2,255,091 | A | * | 9/1941 | Vaughn | 15/260 |
| 2,358,750 | A | | 8/1942 | Walker | |
| 2,623,230 | A | * | 12/1952 | Feinen | 15/142 |
| 2,689,017 | A | | 9/1954 | Schmid | |
| 2,827,647 | A | * | 3/1958 | Speer | 15/105 |
| 2,864,504 | A | | 12/1958 | Jepson | |
| 2,908,445 | A | | 10/1959 | Schwartz | |
| 3,295,686 | A | | 1/1967 | Krueger | |
| 3,570,502 | A | | 3/1971 | Farnsworth | |
| 3,662,780 | A | | 5/1972 | Marsh | |
| 3,920,347 | A | | 11/1975 | Sauriol et al. | |
| 4,021,354 | A | | 5/1977 | Lyon | |
| 4,161,799 | A | | 7/1979 | Sorrells | |
| 4,575,270 | A | | 3/1986 | Hammond | |
| 4,685,472 | A | | 8/1987 | Muto | |
| 4,798,307 | A | | 1/1989 | Evrard | |
| 4,904,378 | A | | 2/1990 | Arai | |
| 5,800,702 | A | | 9/1998 | Taylor-McCune et al. | |
| 5,807,481 | A | | 9/1998 | Hodgkins et al. | |
| 6,000,094 | A | | 12/1999 | Young | |
| 6,006,397 | A | | 12/1999 | Williams et al. | |
| 6,458,303 | B1 | | 10/2002 | Fuehrer et al. | |
| 6,761,271 | B1 | | 7/2004 | Cresswell | |

(Continued)

*Primary Examiner* — Mark Spisich
(74) *Attorney, Agent, or Firm* — VanOphem & VanOphem, PC

(57) ABSTRACT

A cleaning system for removing abrading material adapted to remove and keep separated the abrasive contaminants from a wash rag, mitt, or brush which is capable of being mounted within a standard 5 gallon bucket for the purposes of washing a car, boat, recreational vehicle or the like. The cleaning system is a lattice structure including a scrubber grate which is positioned within the bucket such that a wash rag, mitt, or long handled brush is capable of being vigorously rubbed against the scrubber grate such that any abrasive grit or contaminants within the wash rag, mitt, or long handled brush will become dislodged and settle to the bottom of the cleaning fluid within the bucket. The lattice structure also has a receiver base to support the scrubber grate and is located near the bottom of the bucket. The lattice structure receiver base allows abrasive contaminants and debris to settle to the bottom of the bucket. The lattice structure receiver base cross-bar structure results in dampening the agitation of the cleaning fluid below the receiver base causing the abrasive contaminants to remain near the bottom of the bucket.

16 Claims, 3 Drawing Sheets

U.S. PATENT DOCUMENTS

| | | | |
|---|---|---|---|
| 6,786,431 | B2 | 9/2004 | Song |
| 6,808,623 | B2 | 10/2004 | Harris et al. |
| 6,857,583 | B2 | 2/2005 | Attar |
| 6,893,032 | B2 | 5/2005 | Kershaw |
| 6,991,851 | B2 | 1/2006 | Krepski et al. |
| 7,025,880 | B2 | 4/2006 | Lamb |
| 7,178,675 | B2 | 2/2007 | Votel |
| 7,318,247 | B2 | 1/2008 | Libman et al. |

* cited by examiner

CLEANING SYSTEM FOR REMOVING ABRADING MATERIAL

CROSS-REFERENCES TO RELATED APPLICATIONS

This application is a continuation-in-part of U.S. Provisional Patent Application Ser. No. 61/059,930 filed on Jun. 9, 2008.

FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

The invention relates generally to removing heavy contaminant particles of dirt, grit, or debris that become entrapped in a wash rag, wash mitt or wash brush used to clean high gloss surfaces and suspending such contaminants in a cleaning solution, and more particularly to a device for removing particles of dirt, grit, or debris from a long-handle wash brush used to wash a recreational vehicle.

2. Description of Related Art

Manufacturers of products with precision or high gloss surfaces such as mirrors, windows, optical lenses, composites such as Corian® countertops, appliances, metal tools, kitchen and bathroom fixtures, automobiles, recreational vehicles (RV), and boats are well aware of the high risk of scratches, nicks, pitting, staining, corrosion, and discoloration that can occur during manufacturing, assembling, shipping, installation, and refinishing operations of these high gloss surfaces. Therefore, temporary protective coatings are widely used to protect such surfaces from these various products during the material handling process. The surface finishes of new vehicles such as automobiles, boats, or recreational vehicles must often be protected by temporary protective coatings from abrasive particles or other deleterious conditions in the environment during shipment by road, rail, or sea. In these applications, the temporary protective coating on the high gloss surface will become contaminated or dirty, and removal of the temporary protective coating eliminates the contamination, thereby greatly simplifying cleaning of the surface. Once these temporary coatings are removed, the high gloss products are susceptible to scratches or abrasions. In spite of these precautionary steps taken by the manufacturer to avoid abrasions to these high gloss surfaces as well as the use of modern paints and clear coating, automobiles, motorcycles, boats, and recreational vehicles are still susceptible to surface scratches and abrasions after these products are sold to the purchasing public.

A common source of such scratches or abrasions can be dirt, grit, or debris that often accumulates on wash rags, wash mitts, and wash brushes that are used to wash the exterior of the vehicle. Further, automatic car washing equipment utilizing recyclable wash water can also contribute to scratching and abrading of high gloss painted surfaces on automobiles. For this reason alone, some vehicle owners refuse to visit car washes to have their vehicle washed. The alternative is obviously to use a wash rag or wash mitt with a bucket of soapy water and wash the vehicle by hand. Unfortunately, hand washing of an automotive vehicle, boat, or RV is a source of scratches and abrasions caused by the dirt, grit, or debris that often accumulates on the wash rags or washes mitts used to wash the exterior of these vehicles. When a dirty wash rag or wash mitt is placed in a bucket of soapy water for rinsing, the dirt, grit, and debris that has been picked up from the dirty surface of the vehicle is transferred into the bucket of soapy water. As the wash water becomes more contaminated with dirt and grit, the wash rag or wash mitt may actually pickup some of the grit or debris that is suspended in the wash water or that has accumulated in the bucket. Therefore, if the wash rag or wash mitt is not properly rinsed clean, such grit or debris is likely to be transferred back onto the exterior of the glossy surface of the vehicle where it will cause significant damage in the form of scratches to the surface finish of the car, boat, or RV being cleaned.

The prior art has little to offer to solve this problem effectively. One prior art patent addresses this problem, U.S. Pat. No. 7,025,880 issued to Lamb, discloses a system for separating particles of dirt, gravel, grit or other potentially damaging debris from a wash fluid when such fluid is contained in a receptacle such as a bucket. The filter assembly itself is shaped such that it matches the shape of the receptacle and fits firmly within the receptacle. The filter component of the filter assembly has an upward facing side and a downward facing side and is made from a plastic hand mesh, screen, or any other suitable plastic screen-like material. The upward facing side of the filter component includes crossbars that are tapered to minimize the surface area of the filter component. At least two baffles are attached to the downward facing side of the filter component to reduce the motion of the wash fluid around and through the filter assembly. These baffles may include secondary baffle-like structures attached at right angles to the primary baffles for further reducing the movement of the fluid below the filter assembly.

Lamb discloses that after a wash rag or wash mitt which is being used to wash a vehicle or other surface picks up grit, dirt, or debris, the user places the wash rag or wash mitt into the bucket and rubs the wash rag or wash mitt against the filter assembly. The grit, dirt, or debris is loosened from the wash rag or wash mitt and becomes suspended in the wash fluid.

There are several known problems in the use of such prior art dirt, grit, and debris separator. In the first place, the filter assembly sits at the very bottom of the bucket. The diameter of the bucket is the smallest near the bottom of the bucket. Therefore, lateral movement is very limited not as much as for a wash rag than it is for a wash mitt or wash brush. A wash mitt is placed on the hand of a person, particularly a male user with a relatively large hand, leaving little room for lateral movement at the bottom of the bucket. Therefore, the filter assembly has a limited capability of removing grit or debris from a wash mitt because lateral movement of a wash mitt is very limited due to the small diameter of the bucket. Some users have solved this problem by stacking multiple filter assemblies within a bucket so that the upper surface of the filter assembly is at a raised level within the bucket such that it becomes easier to reach as well as provided a little more lateral room to allow for lateral movement in that the diameter of the bucket increases as you approach the open end of the bucket. Such a solution can be expensive. Further, in using the bucket receptacle with the single filter element or multiple elements mounted at the bottom thereof, it is impossible to clean a brush with any type of handle since the bucket is not large enough in diameter to place all of the bristles of the brush against the filter element because the handle of the brush cannot be accommodated within the diameter of the bucket. Therefore, what is needed is a wash bucket with a simple inexpensive insert which will permit the removal of grit, dirt, or debris from wash rags, wash mitts, as well as wash brushes with long or short flow through or non-flow through handles typically used in the cleaning of an RV vehicle.

BRIEF DESCRIPTION OF THE INVENTION

The invention is a lattice structure intended, according to the preferred embodiment, to be used with a common five gallon bucket receptacle for washing high gloss surfaces such as boats, automobiles, and recreational vehicles (RV). Combined with such five gallon bucket the invention provides a system for separating grit, gravel, or dirt particles as well as other damaging debris from wash rags, wash mitts and particularly, extended handle brushes placed into a wash fluid, such as soapy water, by separating the debris, grit, or dirt particles from the wash fluid contained in the bucket receptacle by collecting underneath the lattice structure.

The lattice structure is a two piece assembly consisting of a plastic molded receiver base for receiving an adjustable upstanding molded scrubber grate. Both the receiver base and the scrubber grate are molded from a high density polyethylene plastic. The scrubber grate is mounted to the receiver base at an acute angle relative to the central axis of the bucket. The receiver base sits transverse to the central axis of the bucket at the bottom thereof. It consists of a plurality of concentrically molded ribs with equally spaced circumferentially disposed radial ribs that provide a structural interface for each of the plurality of concentrically disposed ribs so as to create a structurally rigid, integrally formed receiver base. In the preferred embodiment, the receiver base has a plurality of legs extending from the bottom surface thereof to elevate the receiver base from the bottom surface of the bucket. The legs are integrally molded to the receiver base in the form of tubular stanchion posts which are hollow and serve as a receiver for a complementary plurality of extending lugs along the bottom edge of the upstanding scrubber grate.

The upstanding scrubber grate attached to the receiver base has an outer peripheral form similar to a parabola. Between the outer extremities are integrally molded laterally extending support beams that provide support for the outer peripheral parabolic edges. The support beams are approximately horizontally disposed at selected spaced distances. Each support beam is further linked to adjacent beams by trusses to provide structural integrity to the upstanding scrubber grate. Further, each beam has a plurality of small ribs integrally molded to each support beam to assist in extracting contaminants from the nap of a wash rag, wash mitt, or wash brush that is rubbed vigorously across the ribs of the scrubber grate.

The parabolic segment of the scrubber grate terminates at its apex into an upstanding tab. When the lattice structure is placed into a bucket this upstanding tab is located in the vicinity of the structural ribs or reinforcement collars that are found on all common five gallon buckets. The reinforcement collars are generally found near the open end of the bucket and are integrally molded to the outside diameter of the buckets. Since the placement of these ribs does vary between bucket manufacturers, the scrubber grate provides longitudinal adjustment so that a screw mounted to the upstanding tab of the scrubber grate can be screwed into the structural rib of the bucket to secure the lattice structure within the bucket. The scrubber grate is adjustable by the extending lugs on the bottom edge of the scrubber grate being located in the tubular posts of the receiver base, so that if the screw in the tab along the apex of the scrubber grate does not align with a reinforcement collar, the scrubber grate can be lifted upward to allow the extending lugs to slide within the tubular hollow posts until the screw within the upstanding tab lines up with a reinforcement collar to which it can be secured.

The primary objective of the invention is to provide a new and improved device for cleaning high gloss surfaces to remove particles of grit, dirt, or debris from wash rags, wash mitts and/or wash brushes so as to eliminate scratches and abrasions from these high gloss surfaces when they are washed by a car detailer, or automobile, boat, and RV owners.

Another object of the invention is to provide a novel cleaning device which can conveniently be used to wash high gloss surfaces and is easy to transport and maneuver by the car detailer.

A further object of the invention is to provide a novel cleaning device wherein long handled brushes used to clean high gloss surfaces can be quickly cleaned to remove dirt particles of grit and debris so as to prevent washing induced swirls and scratches on such high gloss surfaces.

It is yet a further object of the invention to provide a cleaning lattice framework wherein a single device can accomplish the objectives of the invention instead of having to purchase several filter assemblies with a single bucket to avoid the shortcoming of using only one filter element.

It is yet a further object of the invention to provide a novel cleaning lattice framework that is securely mounted in a standard five gallon bucket and further provides sliding adjustment with respect to the receiver base to secure the lattice framework within the standard five gallon bucket.

Other advantages and features of the present invention will become more apparent from the following detailed description when read in conjunction with the accompanying drawings and claims.

DETAILED DESCRIPTION OF THE PREFERRED EMBODIMENT

Figure 1:
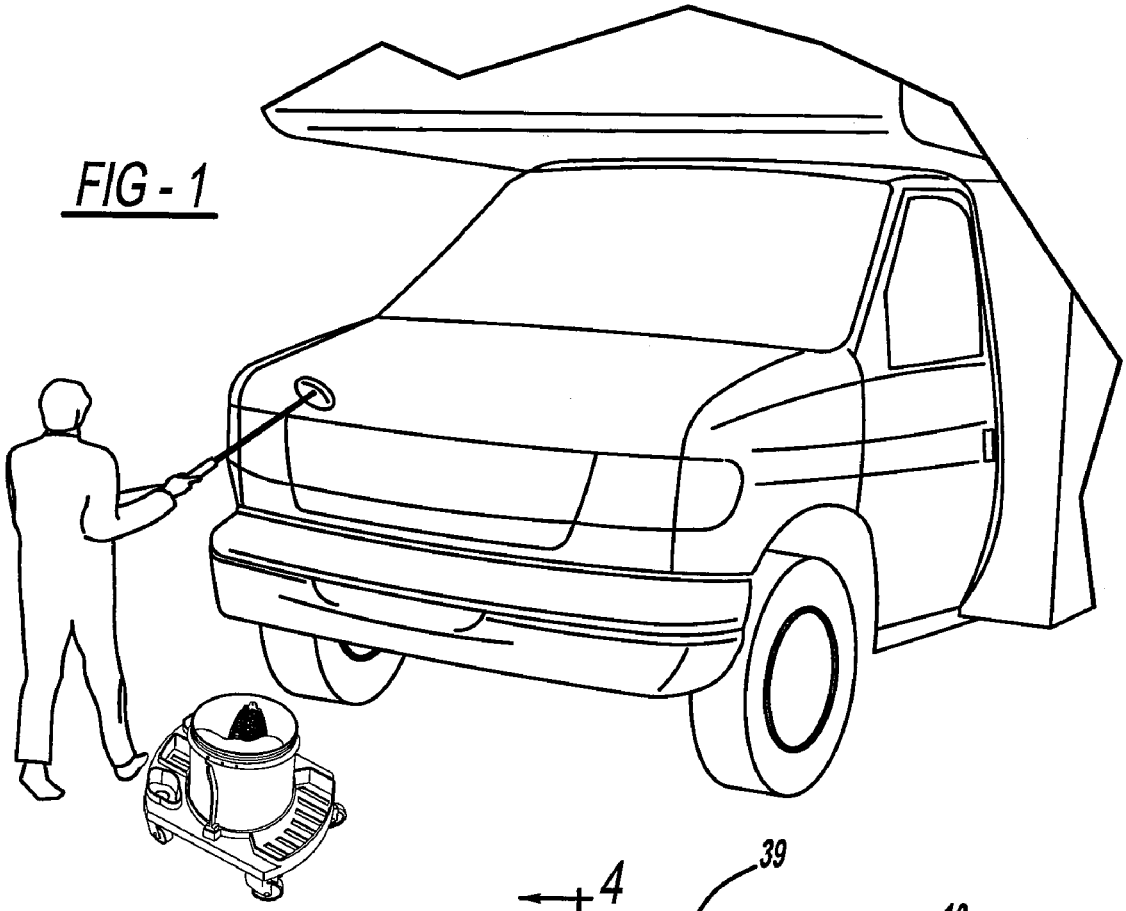
FIG. 1 is a perspective drawing of the invention used by a car detailer for cleaning an RV vehicle.
Figure 3:
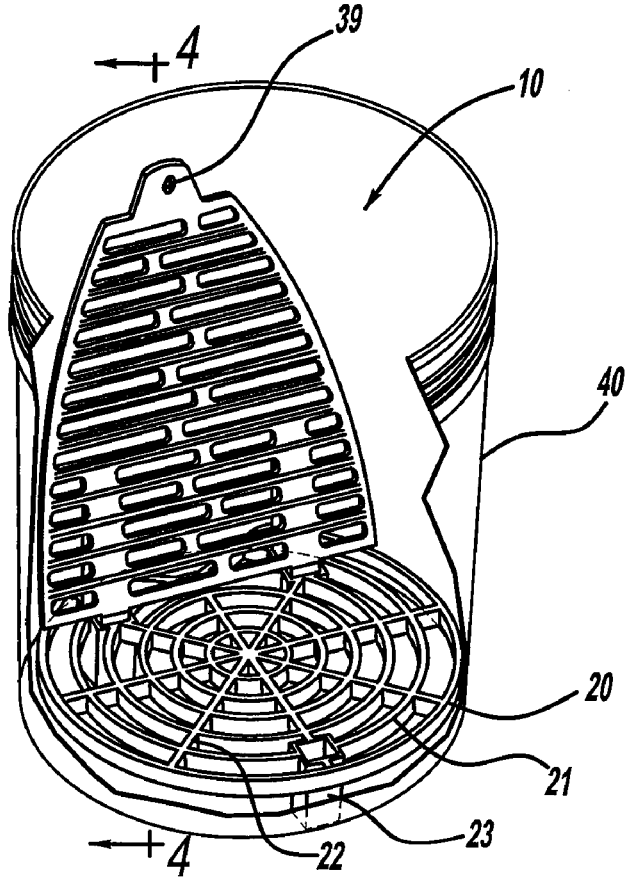
FIG. 3 is a perspective view of the lattice framework mounted in a five gallon bucket with portions of the bucket cut-away.

Referring now to the drawings, in particular FIGS. 1-4, there is shown a lattice structure intended to be mounted in a common five gallon bucket for cleaning high gloss surfaces such as boats, automobiles, and recreational vehicles (RV). The preferred embodiment of the lattice framework mounted in a standard bucket provides a system for separating grit, gravel, or dirt particles as well as other damaging debris from wash rags, wash mitts and particularly wash brushes used with a washing fluid such as soapy water and thereafter segregate the debris, grit, or dirt particles in the wash fluid contained in the bucket receptacle.

Figure 2:
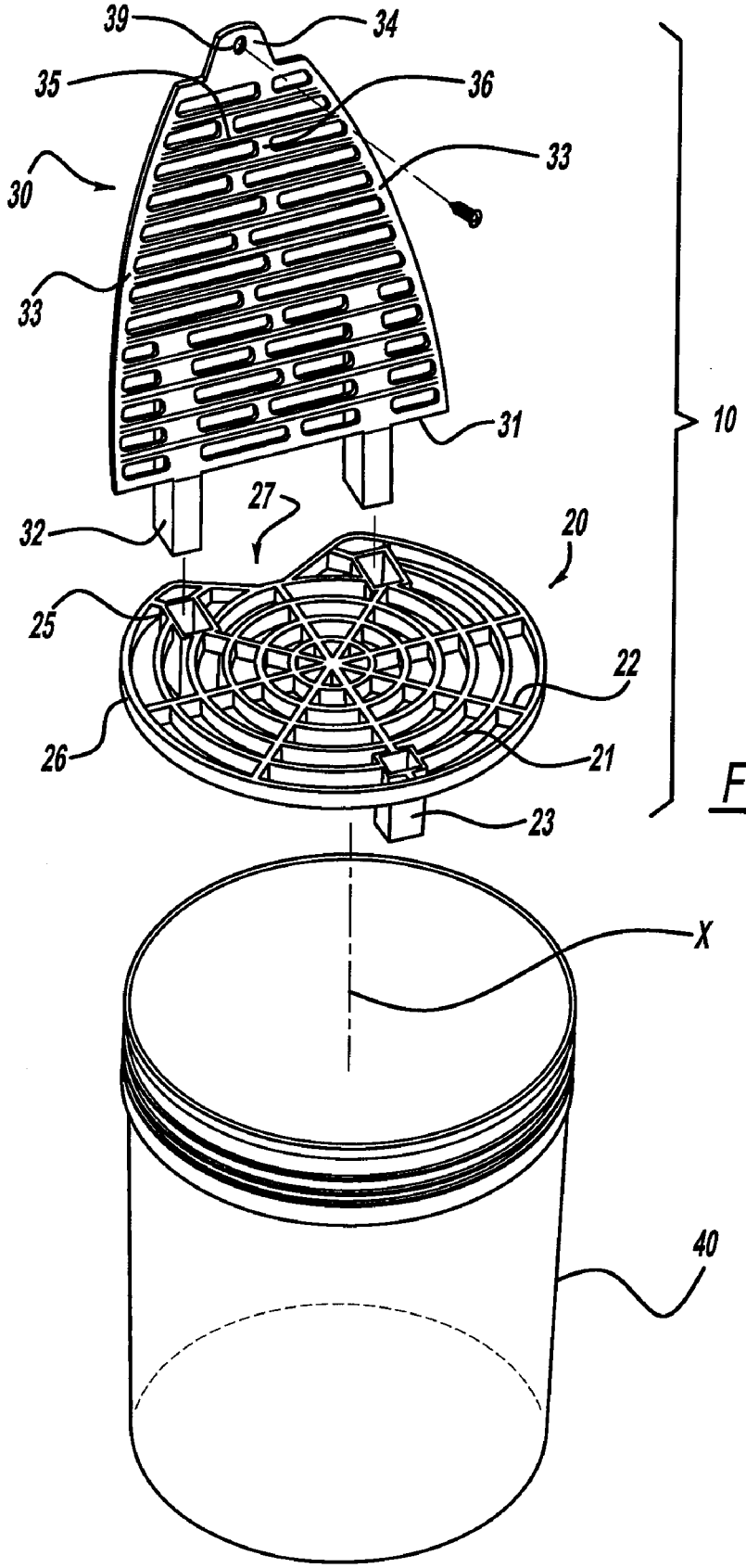
FIG. 2 is an exploded view of the lattice framework and bucket arrangement of the present invention.

The lattice structure 10 is a two-piece assembly consisting of a plastic molded receiver base 20 for receiving an adjustable upstanding plastic molded scrubber grate 30. Both the plastic molded receiver base 20 and the scrubber grate 30 are molded from a high density polyethylene plastic. The scrubber grate 30 is mounted to the plastic molded receiver base 20 at an acute angle relative to the central axis of the five gallon bucket 40. The plastic molded receiver base 20 sits transverse to the central axis "X" of the bucket 40 at the bottom thereof as is shown in FIG. 2.

The plastic molded receiver base 20 consists of a plurality of concentrically molded ribs 21 with equally spaced circumferentially disposed radial ribs 22 that provide a structural interface for each of the plurality of concentrically disposed molded ribs 21 so as to create a structurally integrated plastic molded receiver base 20. The concentric ribs 21 and radial ribs 22 or crossbars illustrated in the preferred embodiment are not intended to be limiting. The plastic molded receiver base 20 structure may take the form of a variety of configurations. For example, instead of the ribs being made by concentric and radial crossbars, it is foreseeable that this structure could by honeycomb shaped, dual shaped, round, oblong, or rectangular. Also, the plastic molded receiver base 20 may be molded into a plurality of sections; each section may be of a different configuration. It is to be understood that a variety of configurations of crossbars are possible. The preferred embodiment also illustrates three support legs 23 extending from the bottom surface 24 of the plastic molded receiver base 20 to elevate the plastic molded receiver base 20 from the bottom surface 24 of the bucket 40. The three support legs 23 are integrally molded with the plastic molded receiver base 20 in the form of tubular stanchions or posts 25 which are hollow and serve as a receiver for a complementary plurality of extending lugs along the bottom edge of the upstanding scrubber grate as will be disclosed hereinafter.

The plastic molded receiver base 20 is peripherally shaped and sized to fit the particular bucket 40 it will be used in. The preferred embodiment was chosen to be round since most buckets 40 are round. However, the peripheral shape or configuration of either the bucket 40 or plastic molded receiver base 20 has no specific limitation as long as when the plastic molded receiver base 20 is seated in the bottom of the bucket 40, the periphery thereof is adjacent the inside surface of the bucket 40. Therefore, the plastic molded receiver base 20 and bucket 40 may be of any peripheral shape. There is, however, a portion of the plastic molded receiver base 20 that is not adjacent to the bucket's 40 inside diameter. The two tubular posts 25 that are used for receiving the extension lugs of the scrubber grate 30 are spaced near the outer edge 26 of the plastic molded receiver base 20. The outer edge 26 of the plastic molded receiver base 20 between the two tubular posts 25 is notched 27 inwards, in a direction away from the bucket's 40 inside diameter so as to create an opening in the plastic molded receiver base 20 to provide a passage for dirt, grit, gravel, or debris particles that are removed from either the wash rag, wash mitt or wash brush due to vigorous rubbing/scrubbing to allow these particles to migrate downwards in the cleaning liquid and drop to the bottom of the bucket 40 to bypass the plastic molded receiver base 20. The concentric ribs 21 and radial ribs 22 of the plastic molded receiver base 20 are formed to reduce any agitation of the liquid below the plastic molded receiver base 20, therefore the motion or agitation of the cleaning liquid in the bottom of the bucket 40 underneath the plastic molded receiver base 20 will be significantly dampened while a user is vigorously rubbing a wash rag, wash mitt or wash brush against the scrubber grate 30 above the plastic molded receiver base 20. The fact that the vigorous action taken to scrub the wash rag, wash mitt, or wash brush against the scrubber grate 30 is located well above the plastic molded receiver base 20 within the bucket 40 is a significant improvement over the prior art for the reason that, in the prior art all of the vigorous scrubbing occurs at or near the bottom of the bucket 40. This scrubbing action will cause agitation of the cleaning fluid as well as agitation of the contaminants near the bottom of the bucket resulting in keeping the contamination in suspension longer due to the continued agitation caused by the vigorous rubbing against the prior art device. Since in the invention, the vigorous scrubbing occurs against the upright scrubber grate 30, the agitation within the bucket 40 occurs at a much higher level within the bucket 40. Therefore, the liquid near the lowest area of the bucket 40 is not agitated as much as in the prior art device resulting in the contaminants not being disturbed and staying below the plastic molded receiver base 20 along the bottom of the bucket 40. Since the majority of the contaminants will be removed by the scrubber grate 30 and discharged into the washing fluid along the backside of the scrubber grate 30, gravity will assist the suspended contaminants to migrate directly to the bottom of the bucket 40 through the passage created by the notch 27 in the outer edge 26 of the plastic molded receiver base 20. These contaminants will be constrained to remain along the bottom of the bucket 40 due to the dampening effect on liquid movement caused by the rib structure of the plastic molded receiver base 20.

The scrubber grate 30 is attached along its bottom edge 31 to the plastic molded receiver base 20 by two extending lugs 32 that slide into the tubular posts 25 of the plastic molded receiver base 20. The outer peripheral upper portion of the scrubber grate 30 is in the form of a parabola with converging sides 33 that terminate at its apex into an upstanding tab 34. Between the outer extremities of the converging sides 33 are integrally molded support beams 35 to provide structural integrity for the outer parabolic shape. The support beams 35 extend approximately horizontally at selected spaced apart equal distances. Each support beam 35 is further integrally linked by the molding process to adjacent support beams 35 by trusses 36 to provide a rigid surface against which wash rags, wash mitts, and wash brushes can be vigorously scrubbed. To insure thorough cleaning of the wash rag or wash mitt as well as a wash brush that is used to wash a high gloss surface, two protruding rib fingers 37 are molded on each support beam 35 that extend between the converging sides 33 of the parabolic form of the scrubber grate 30. These protruding rib fingers 37 are provided so that the nap of the wash rag or wash mitt can be disturbed so as to release the particles of grit, dirt, or gravel that may have migrated therein. Vigorous movements of the wash rag, wash mitt or wash brush across these protruding rib fingers 37 will facilitate the removal of the smaller contaminant particles to insure that they are extracted from the wash rag, wash mitt or wash brush so that they will not be transferred back on to the wash rag, mitt or brush, and cause scratches and swirl marks on the gloss and finish on the article being washed.

Figure 4:
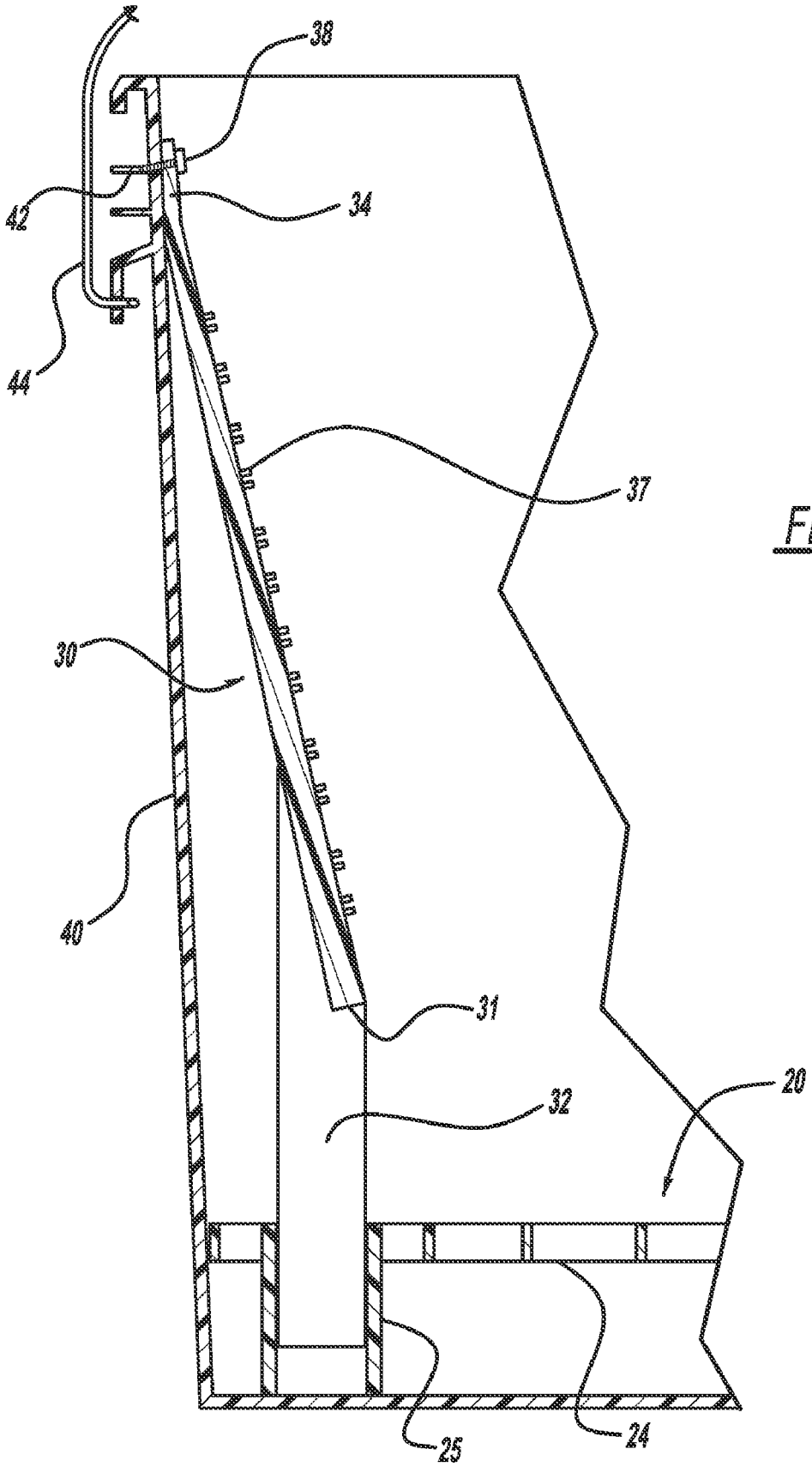
FIG. 4 is a perspective view of the lattice framework with the scrubber grate elevated but aligned with the tubular posts of the receiver base to illustrate the adjustable mounting of the scrubber grate to the receiver base.

As discussed above, the parabolic or converging sides 33 of the scrubber grate 30 terminates at its apex in an upstanding tab 34. When the lattice structure 10 is placed into a bucket 40 as illustrated in FIG. 4, the upstanding tab 34 is located in the general area of the reinforcement collars 42 that are found on all common five gallon buckets. These reinforcement collars 42 are located near the top of the bucket 40. A wire or plastic handle 44 is usually attached near the top or open end of the bucket 40 within the area of the reinforcement collars 42 and is integrally molded to the outside diameter of the bucket 40. Since the precise location of the reinforcement collar 42 will vary between bucket manufacturers, the scrubber grate 30 provides vertical adjustment to enable the lattice structure 10 to be secured to the bucket 40. For this purpose the upstanding tab 34 of the scrubber grate 30 is provided with a small opening 39 to allow a mounting screw 38 to be mounted therein and screwed into a reinforcement collar 42 of the bucket 40 so as to secure the lattice structure 10 within the bucket 40. The scrubber grate 30 is adjustable by the extending lugs 32 along the bottom edge 31 of the scrubber grate 30 being mounted in the tubular posts 25 of the plastic molded receiver base 20, so that, if the mounting screw 38 in the upstanding tab 34 at the apex of the scrubber grate 30 does not line up with a reinforcement collar 42 of the bucket 40, the complete scrubber grate 30 can be lifted vertically to allow extending lugs 32 to slide within the tubular hollow posts 25 until the mounting screw 38 within the upstanding tab 34 lines up with a reinforcement collar 42 and is secured thereto to secure the lattice structure 10 within the bucket 40.

From the foregoing, it will be seen that the invention is one well adapted to obtain all the objects herein set forth, together with other advantages which are obvious and which are inherent in the structure.

It will be understood that certain features and sub-combinations are of utility and may be employed without reference to other features and sub-combinations. This is contemplated by and well within the scope of the claims herein. Although the preferred embodiment is shown in the drawings, many other embodiments may be made of the invention without departing from the scope thereof. For example, the shape of the bucket may be of any configuration providing the receiving base is also of the same shape. The number of legs may be less or more than the preferred embodiment providing the legs compliment the extending lugs of the scrubber grate to orient the scrubber grate at an acute angle with respect to the centerline "X" of the bucket. It is undisputed that all matter herein set forth shown in the accompanying drawings is to be interpreted as illustrative and not in a limiting sense.

What is claimed is:

1. A cleaning system adapted for removing abrasive contaminants from wash rags, wash mitts, sponges, and wash brushes, said cleaning system comprising:

a bucket having a closed end and an open end opposite said closed end; and an adjustable lattice framework structure removably mounted in said bucket juxtaposed said closed end, said adjustable lattice structure comprising:

a receiver base having a plurality of intersecting crossbars defining a rib structure, said rib structure having a plurality of openings therethrough between said intersecting crossbars;

means for elevating said receiver base from said closed end of said bucket; and a scrubber grate member adjustably mounted to said receiver base, said scrubber grate member having one end adjustably mounted to said receiver base and an opposite end extending in a direction towards said open end of said bucket, said opposite end terminating in an apex, said apex of said scrubber grate defining a tab;

means for attaching said tab of said scrubber grate to said bucket; and means for mounting said scrubber grate to said receiver base.

2. The cleaning system as claimed in claim 1 wherein said means for elevating said receiver base further comprises at least one upstanding support leg member integral with said rib structure, said at least one support leg member having a hollow tubular portion facing in a direction towards said open end of said bucket, whereby said at least one upstanding support member elevates said receiver base from said closed end of said bucket when said adjustable lattice structure is mounted in said bucket.

3. The cleaning system as claimed in claim 2 wherein said means for mounting said scrubber grate to said receiver base further comprises:

said one end of said scrubber grate defining a bottom edge;

at least one lug member extending from said bottom edge of said scrubber grate, said at least one extending lug removably mounted in said hollow tubular portion of said at least one support leg member.

4. The cleaning system as claimed in claim 3 further comprising:

a plurality of reinforcing collars molded to the outer surface of said bucket near said open end; and wherein said means for attaching said tab of said scrubber grate further comprises:

a hole in said tab of said scrubber grate;

a screw member located in said hole in said tab;

means for moving said scrubber grate in the longitudinal direction of said bucket, whereby said at least one lug extending from said bottom edge of said scrubber grate slides within said hollow tubular portion of said at least one support leg to permit alignment of said screw member with one of said reinforcement collars of said bucket and be threaded therein to secure said lattice structure within said bucket.

5. The cleaning system as claimed in claim 2 wherein said scrubber grate further comprises:

a converging frame member having a bottom edge at one end thereof and an opposite end having said apex defining said tab;

a plurality of support beams extending between converging sides of said frame member;

a plurality of truss members laterally extending between adjacent support beams of said plurality of support beams, said plurality of truss members providing rigidity to said plurality of support beam members whereby when a wash rag, wash mitt, or wash brush is vigorously rubbed against said scrubber grate said converging frame member remains substantially rigid; and at least one lug extending from said bottom edge of said converging frame member, said at least one lug member slidably mounted to said hollow tubular portion of said at least one hollow tubular portion of said support leg member.

6. The cleaning system as claimed in claim 1 wherein said receiver base further comprises a peripheral shape complimentary a peripheral shape of said bucket, said peripheral shape of said receiver base further having a notched portion defining an opening between said receiver base and the inside surface of said bucket.

7. A cleaning system adapted for removing abrasive contaminants from wash rags, wash mitts, and wash brushes, said cleaning system comprising:

a bucket having a closed end, and open end opposite said closed end, and a plurality of reinforcing collars molded to the outer surface of said bucket near said open end; and an adjustable lattice framework structure removably mounted in said bucket juxtaposed said closed end, said adjustable lattice framework comprising:

a receiver base having a peripheral shape complimentary a peripheral shape of said bucket;

a plurality of intersecting crossbars defining a rib structure within said peripheral shape, said rib structure having a plurality of openings therethrough between said intersecting crossbars;

said peripheral shape of said receiver base having a notched portion defining an opening between said receiver base and the inside surface of said bucket; and means for elevating said receiver base from said closed end of said bucket;

a scrubber grate member comprising:

a converging frame member having a bottom edge at one end thereof and an opposite end terminating in an apex defining a tab member;

a plurality of support beams extending between converging sides of said frame member; and a plurality of truss members laterally extending between adjacent support beams of said plurality of support beams, said plurality of truss members providing rigidity to said plurality of support beam members whereby when a wash rag, wash mitt, or wash brush is vigorously rubbed against said scrubber grate, said converging frame member remains substantially rigid; and means for adjustably mounting said scrubber grate member to said receiver base.

8. The cleaning system as claimed in claim 7 wherein said means for elevating said receiver base further comprises at least one upstanding support leg member integral with said rib structure, said at least one support leg member having a hollow tubular portion facing in a direction towards said open end of said bucket, whereby said at least one upstanding support leg member elevates said receiver base from said closed end of said bucket when said adjustable lattice structure is mounted in said bucket.

9. The cleaning system as claimed in claim 8 wherein said means for mounting said scrubber grate to said receiver base further comprises at least one lug member extending from said bottom edge of said converging frame member, said at least one lug member slidably mounted to said hollow tubular portion of said at least one support leg member.

10. The cleaning system as claimed in claim 9 wherein said tab member further comprises a hole drilled therethrough; and wherein said cleaning system further comprises a threaded screw mounted in said hole of said tab member; and means for moving said scrubber grate in the longitudinal direction of said bucket, whereby said at least one lug extending from said bottom edge of said scrubber grate slides within said hollow tubular portion of said at least one support leg to permit alignment of said screw member with one of said reinforcement collars of said bucket and be screwed therein to secure said lattice structure within said bucket.

11. A lattice framework apparatus adapted for use in a cleaning bucket, said cleaning bucket having an open end, a closed end, and a plurality of reinforcing collars on the outer diameter near said open end, said lattice framework apparatus comprising:

a receiver base having a plurality of intersecting crossbars defining a rib structure, said rib structure having a plurality of openings therethrough between said intersecting crossbars;

means for elevating said receiver base from said closed end of said bucket;

a scrubber grate member adjustably mounted to said receiver base, said scrubber grate member having one end adjustably mounted to said receiver base and an opposite end extending in a direction towards said open end of said bucket, said opposite end terminating in an apex, said apex of said scrubber grate defining a tab;

means for mounting said scrubber grate to said receiver base; and means for attaching said tab of said scrubber grate to said bucket.

12. The lattice framework apparatus as claimed in claim 11 wherein said receiver base further comprises a peripheral shape complimentary a peripheral shape of said bucket, said peripheral shape of said receiver base further having a notched portion.

13. The cleaning system as claimed in claim 11 wherein said means for elevating said receiver base further comprises at least one upstanding support leg member integral with said rib structure, said at least one support leg member having a hollow tubular portion facing in a direction towards said open end of said bucket, whereby said at least one upstanding support member elevates said receiver base from said closed end of said bucket when said adjustable lattice structure is mounted in said bucket.

14. The cleaning system as claimed in claim 13 wherein said means for mounting said scrubber grate to said receiver base further comprises:

said one end of said scrubber grate defining a bottom edge;

at least one lug member extending from said bottom edge of said scrubber grate, said at least one extending lug removably mounted in said hollow tubular portion of said at least one support leg member.

15. The cleaning system as claimed in claim 14 wherein said means for attaching said tab of said scrubber grate further comprises:

a hole in said tab of said scrubber grate;

a screw member located in said hole in said tab;

means for moving said scrubber grate in the longitudinal direction of said bucket, whereby said at least one lug extending from said bottom edge of said scrubber grate slides within said hollow tubular portion of said at least one support leg to permit alignment of said screw member with one of said reinforcement collars of said bucket and be threaded therein to secure said lattice structure within said bucket.

16. The cleaning system as claimed in claim 13 wherein said scrubber grate further comprises:

a converging frame member having a bottom edge at one end thereof and an opposite end having said apex defining said tab;

a plurality of support beams extending between converging sides of said frame member;

a plurality of truss members laterally extending between adjacent support beams of said plurality of support beams, said plurality of truss members providing rigidity to said plurality of support beam members whereby when a wash rag, wash mitt, or wash brush is vigorously rubbed against said scrubber grate said converging frame member remains substantially rigid; and at least one lug extending from said bottom edge of said converging frame member, said at least one lug member slidably mounted to said hollow tubular portion of said at least one hollow tubular portion of said support leg member.

* * * * *